US005752699A

United States Patent [19]

Crompton et al.

[11] Patent Number: 5,752,699

[45] Date of Patent: May 19, 1998

[54] COIN OPERATED AMUSEMENT MACHINE

[75] Inventors: Gordon Crompton, Broadstairs; Simon Osborn, Ramsgate, both of England

[73] Assignee: Cromptons Leisure Macines, Limited, Kent, England

[21] Appl. No.: 766,916

[22] Filed: Dec. 13, 1996

Related U.S. Application Data

[63] Continuation of Ser. No. 683,542, Jul. 15, 1996, abandoned.

[30] Foreign Application Priority Data

Jul. 17, 1995 [GB] United Kingdom ..... 9514572

[51] Int. Cl.[6] ..... A63F 7/02

[52] U.S. Cl. ..... 273/138.2; 273/454; 273/138.3

[58] Field of Search ..... 273/138.1, 138.2, 273/138.3, 138.4, 138.5, 441, 459, 454; 453/1, 2, 18, 29, 58; 194/202, 215

[56] References Cited

U.S. PATENT DOCUMENTS

| | | | |
|---|---|---|---|
| 4,342,384 | 8/1982 | Fukase | 273/138.2 |
| 4,662,636 | 5/1987 | Crompton | 273/138.2 |
| 5,275,402 | 1/1994 | Malavazos et al. | 273/138.2 |
| 5,297,816 | 3/1994 | Becchio | 273/459 |
| 5,355,988 | 10/1994 | Shirasawa . | |
| 5,462,286 | 10/1995 | Roberts | 273/459 |
| 5,467,857 | 11/1995 | Takemoto | 273/138.2 |

FOREIGN PATENT DOCUMENTS

| | | |
|---|---|---|
| 0 250 226 | 12/1987 | European Pat. Off. . |
| 2014 275 | 10/1971 | Netherlands . |
| 2 124 913 | 2/1984 | United Kingdom . |
| 2 272 383 | 5/1994 | United Kingdom . |
| 2 293774 | 4/1996 | United Kingdom . |
| WO 88 03299 | 5/1988 | WIPO . |

*Primary Examiner*—William M. Pierce
*Attorney, Agent, or Firm*—Lowe, Price, LeBlanc & Becker

[57] ABSTRACT

The invention relates to a coin-operated amusement machine. Coins are received on a play area (21). Coins may be displaced from the play area (21) by a mechanism such as a coin pusher (5) or by movement of the play area itself. A counting hopper (8) receives and counts coins which have been displaced from a defined part of the play area, and generates a signal depending on the number of coins counted. A coin dispenser (10) can be operated by a user of the machine to dispense additional coins onto the play area (21). Coins are transferred from the counting hopper (8) to the dispenser (10) by a coin transport mechanism (9). A prize, which may consist of a pay out of coins or other non-cash prize, is dispensed to the user in response to the signal from the counting hopper (8)

3 Claims, 3 Drawing Sheets

COIN OPERATED AMUSEMENT MACHINE

This application is a continuation of application Ser. No. 08/683,542 filed Jul. 15, 1996 now abandoned.

This invention relates to a coin-operated amusement machine having a security feature to prevent unauthorised interference with the machine.

Coin-operated amusement machines are of various kinds. In the context of this specification, the term "coins" should be understood as including any similar discs or tokens or the like.

In belt-type amusement machines, the user projects a coin onto a continuously moving belt. The position on the belt where the coin lands may be detected by sensors, and these may determine prizes won by the user, such as a repayment of coins.

Coin pusher amusement machines are well known. Examples are illustrated in GB-A-2 124 913 and GB-A-2 272 383. Such machines generally include a horizontal playfield, on which a large number of coins is distributed. The pattern of coins on the playfield is periodically disturbed by a coin pusher, which may be in the form of a movable stage which periodically sweeps across part of the playfield surface. Coins are pushed towards an edge of the playfield and some may be pushed over the edge into a "win chute". From this, they pass into a receptacle and may be recovered by the user of the machine. The user is able to introduce additional coins into the machine, which may pass onto the playfield surface directly or via an upper surface of the coin pusher. The object of the user of the machine is to insert such additional coins with the hope that a larger number of coins will be pushed over the edge into the win chute.

Coin-operated amusement machines are often installed in amusement arcades and the like, where there are constant problems of security. Users may attempt to interfere with machines, for example by shaking them to release coins therefrom. Also, dishonest maintenance staff may remove coins from machines when servicing them. The present invention provides a solution to these problems by isolating from the user the "coin of play", i.e. those coins which take part in the "game" in the machine, e.g. those which are on the playfield surface or moving belt or which are pushed from the playfield surface or from the moving belt. According to the invention, such coins are internally recirculated in a closed loop in the machine and kept totally separate from any coins which the user may enter into the machine or which the user may retrieve from the machine by way of a prize.

Thus, the present invention provides a coin-operated amusement machine, comprising a play area for receiving coins;

means for displacing coins from the play area;

a counting hopper for receiving and counting coins which have been displaced from a defined part of the play area and able to generate a signal depending on the number of coins counted;

coin dispensing means, operable by a user of the machine, for dispensing additional coins onto the play area;

means for transferring coins from the counting hopper to the coin dispensing means; and reward means for dispensing a prize to the user in response to the signal from the counting hopper.

In one embodiment, the invention provides an amusement machine of the coin pusher type, comprising a playfield having a flat, horizontal upper surface, adapted in use to support coins;

a coin pusher which, in use, periodically sweeps across at least part of the playfield surface so as to disturb coins distributed thereon, whereby some coins may be pushed over at least one edge of the playfield surface;

a counting hopper for receiving and counting coins which have been pushed over the edge of the playfield surface and able to generate a signal depending on the number of coins counted;

coin dispensing means, operable by a user of the machine, for dispensing additional coins onto the playfield surface;

means for transferring coins from the counting hopper to the coin dispensing means; and reward means for dispensing a prize to the user in response to the signal from the counting hopper.

Reference is now made to the accompanying drawings, in which.

Figure 1:
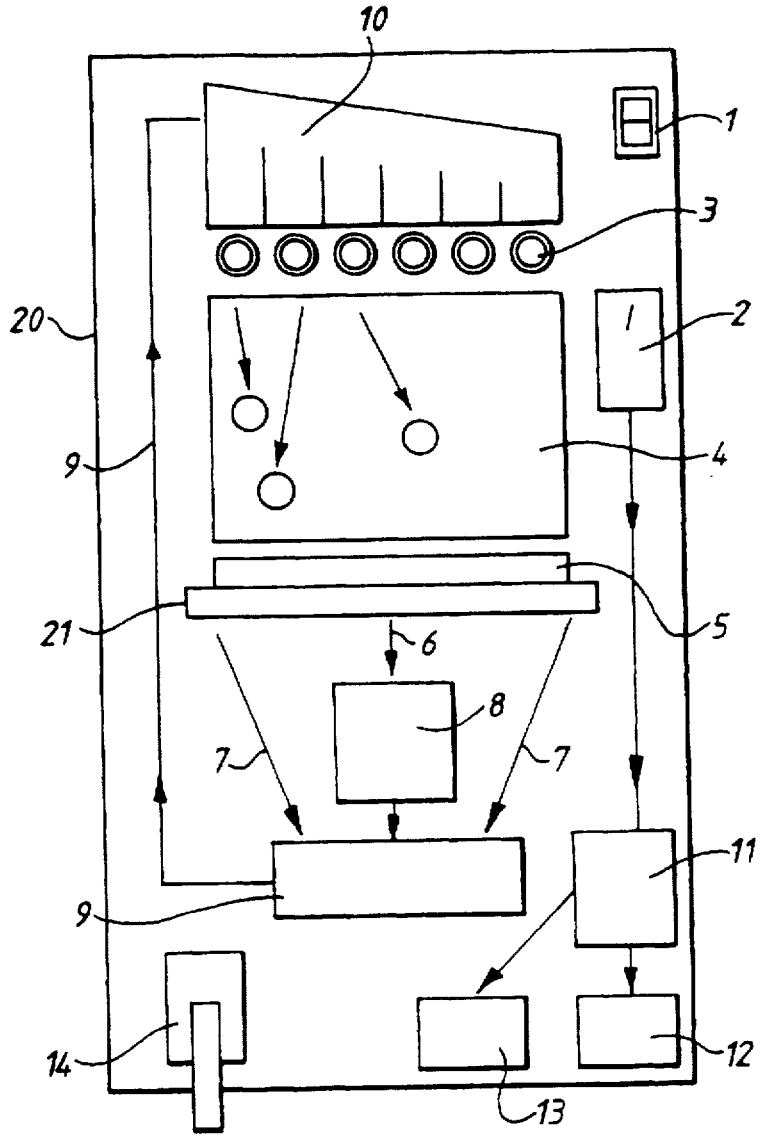
FIG. 1 is a diagrammatic representation of a coin pusher amusement machine according to a preferred embodiment of the invention.
Figure 2:
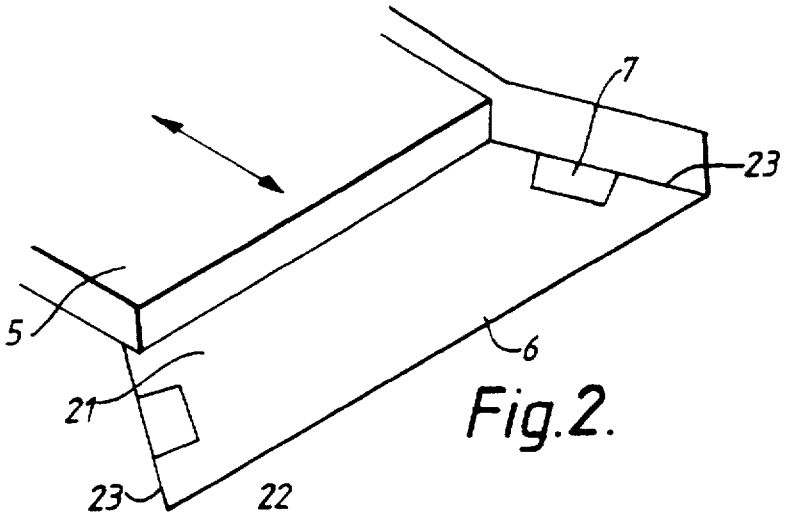
FIG. 2 shows a detail of the machine of FIG. 1.

Referring first to FIGS. 1 and 2, the machine is housed in a cabinet 20. A playfield 21 provides a flat, horizontal upper surface on which a large number of coins (not shown) is distributed. A coin pusher 5 is in the form of a stage or box which continuously moves backwards and forwards across at least part of the playfield surface. Coins on the playfield surface are thus pushed towards a front edge 22 and towards side edges 23 of the playfield surface (FIG. 2). At each side edge 23 there is a "lose" chute 7, which may be adjusted in size by the operator of the machine. At the front edge there is a "win" chute 6, through which coins pass after being pushed over the front edge.

Coins which pass down the win chute 6 are received by a counting hopper 8. This includes conventional means for counting the coins received and generating an electronic signal which is proportionate to the number of coins counted.

After being counted in the counting hopper 8, the coins pass to an escalator unit 9. The escalator unit 9 also receives coins which have passed down the lose chutes 7. The escalator unit 9 operates continuously to transfer such coins to a coin holder/dispenser unit 10. This is arranged generally above the playfield, and holds a store of coins arranged in several stacks. Coins are fed to these stacks by the escalator unit 9. Each stack is provided with a respective coin release button 3 operable by the user of the machine. When a coin release button 3 is actuated, a coin is released from the respective stack. This coin then falls through a pin perspex (Perspex is a Trade Mark) member 4 and onto the playfield surface, either directly or via an upper surface of the pusher box. The pin Perspex member 4 comprises two sheets of Perspex placed face-to-face, and spaced apart with a gap just slightly greater than the thickness of a coin. A random arrangement of metallic pins connects the two sheets. Coins can thus fall down between the sheets and bounce off the metallic pins on the way down. This introduces an element of randomness in the passage of coins from the dispenser 10 to the playfield.

The user is able to operate the machine by inserting coins, by other payment means such as bank notes or credit cards, or the machine may even be arranged for "free play". An important feature is that any coins inserted into the machine by the user are kept separate from those coins actually in use in the machine, on the playfield, escalator unit and coin holder/dispenser. In the case where the user has to insert coins to operate the machine, the coins are entered through a conventional coin slot and received by a coin validator 2. This is a conventional mechanism which counts the value of the coins entered. This actuates an electronic counting means which gives the user a corresponding number of "credits", which are displayed at a credit display 1. These credits permit the user to actuate a corresponding number of coin release buttons 3 until the credits are used up, after which the user has to insert more coins to operate the machine. A corresponding mechanism operates where the user employs payment means other than coins. A validation mechanism notes the value of the payment means introduced by the user, and the user receives a corresponding number of credits.

Where coins are introduced by the user of the machine, these pass from the coin validator 2 to a payout hopper 11. This provides a storage point for coins which may be paid out by the machine as a prize.

The machine incorporates reward means for dispensing a prize to the user in response to the signal from the counting hopper. The signal generated by the counting hopper is a measure of the number of coins falling down the win chute 6. This signal may be used to actuate a coin release mechanism in the payout hopper 11, which will then release a corresponding number of coins from the pay-out hopper. Such released coins pass from the payout hopper to a pay tray 12, which is accessible to the user of the machine.

A predetermined proportion of coins entering the payout hopper 11, in excess of likely payout requirements, may be diverted to a cashbox 13 inside the machine, from which they may subsequently be retrieved by the machine operator.

As an alternative to paying out coins as a prize to the user, the machine may be arranged to release a non-cash prize or a prize-indicating means such as a ticket. For example, the machine may incorporate a ticket payout means 14 which is actuated by the signal generated by the counting hopper 8. The user of the machine then receives a ticket which may be exchanged elsewhere for a cash or non-cash prize.

The counting hopper 8 counts all coins "won" by the user and the corresponding signal generated is passed to a central processor unit where it is held in memory. The prize won by the user can be paid in tokens, tickets, coins entered by the user or previous users, or credits depending on customer requirements. The ratio of "won" coins to paid units is variable by the central processor unit.

All coins paid in and paid out are fully validated and the results stored by the processor unit. Such information stored by the processor unit can be transmitted to a central computer (connected to several such machines). This enables the operator to obtain full statistical analyses of profits and losses, which can be carried out remotely from the machines themselves.

Figure 3:
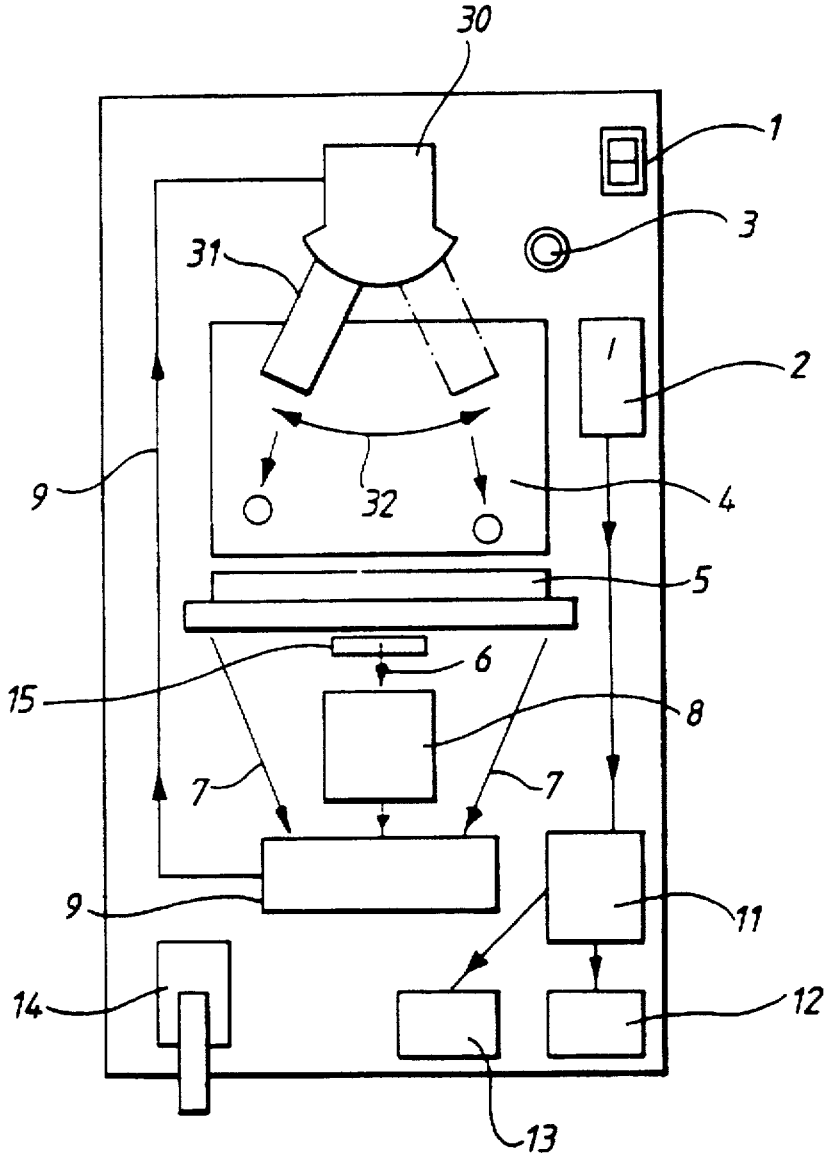
FIG. 3 is a diagrammatic representation of a machine similar to that of FIG. 1 but with a different coin dispensing means.

FIG. 3 shows a machine which is similar to that of FIGS. 1 and 2, and in which the reference numbers have the same meanings, except as follows. In FIG. 3, the coin dispenser 30 incorporates a single coin hopper, fed with coins by the escalator unit 9. The coin hopper has a movable, downwardly disposed coin tube 31, which can be moved by the user of the machine as shown by the arrow 32, to direct coins to different parts of the playfield. A single coin release button 3 is provided, and can be operated by the user a given number of times, depending on the "credits" available to the user. On actuating the release button 3, a coin is released from the hopper 30 into the coin tube 31.

FIG. 3 also shows diagrammatically a tilt mechanism 15. This generally takes the form of a movable flap in the win chute. Known mechanisms are available for detecting unauthorised tilting of the machine or other interference, and these can result in automatic operation of the flap to divert coins from the win chute into the internal cash box 13.

Figure 4:
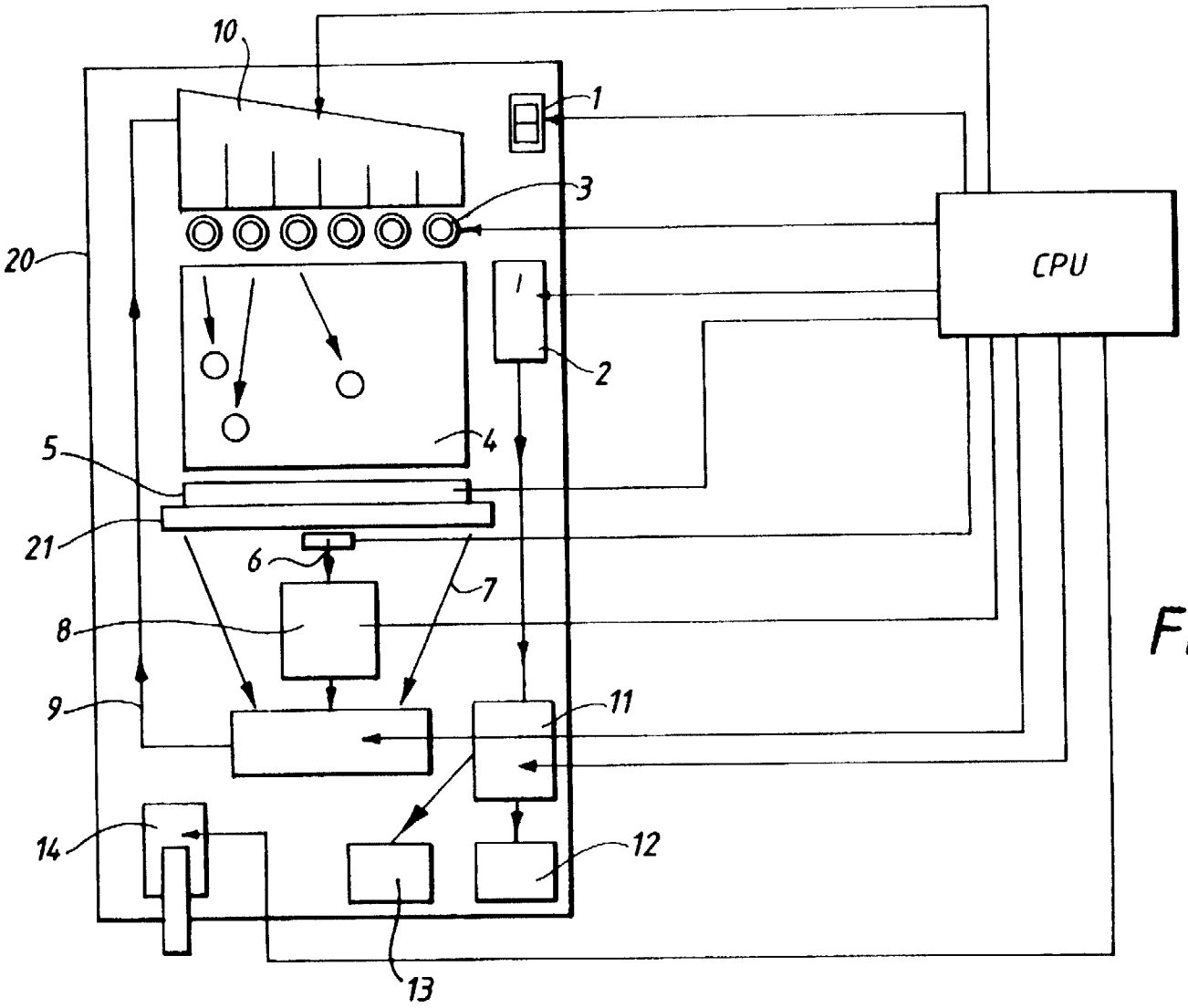
FIG. 4 is a diagrammatic representation showing overall control of the components of the machines of FIG. 1 or FIG. 3 by a central processing unit (CPU).

FIG. 4 shows the interconnection of the central processing unit (CPU) with each of the various parts of the machine of FIG. 1. Each part operates under the control of the CPU as described above.

We claim:

1. A coin operated amusement machine, comprising a play area for receiving coins constituted by a horizontal surface of a moving belt;

means for displacing coins from the play area;

a counting hopper for receiving and counting coins which have been displaced from a defined part of the play area and able to generate a signal depending on the number of coins counted;

coin dispensing means, operable by a user of the machine, for dispensing additional coins onto the play area;

means for transferring coins from the counting hopper to the coin dispensing means; and reward means for dispensing a prize to the user in response to the signal from the counting hopper, wherein the play area, the counting hopper, the coin dispensing means and the means for transferring coins constitute a closed loop for circulation of coins internally in the machine.

2. An amusement machine of the coin pusher type, comprising a playfield having a flat, horizontal upper surface, adapted in use to support coins;

a coin pusher which, in use, periodically sweeps across at least part of the playfield surface so as to disturb coins distributed thereon, whereby some coins may be pushed over at least one edge of the playfield surface;

a counting hopper for receiving and counting coins which have been pushed over the edge of the playfield surface and able to generate a signal depending on the number of coins counted;

coin dispensing means, operable by a user of the machine, for dispensing additional coins onto the playfield surface;

means for transferring coins from the counting hopper to the coin dispensing means; and reward means for dispensing a prize to the user in response to the signal from the counting hopper, wherein the playfield, the counting hopper, the coin dispensing means and the means for transferring coins constitute a closed loop for recirculation of coins internally in the machine.

3. A coin-operated amusement machine, comprising a play area for receiving coins;

means for displacing coins from the play area;

a counting hopper for receiving and counting coins which have been displaced from a defined part of the play area and able to generate a signal depending on the number of coins counted;

coin dispensing means, operable by a user of the machine, for dispensing additional coins onto the play area;

means for transferring coins from the counting hopper to the coin dispensing means; and reward means for dispensing a prize to the user in response to the signal from the counting hopper.

* * * * *